United States Patent [19]

Ishii et al.

[11] Patent Number: 5,037,717

[45] Date of Patent: Aug. 6, 1991

[54] DEVELOPER COMPOSITION FOR ELECTROPHOTOGRAPHY COMPRISING FINE PARTICLES

[75] Inventors: Yukihiro Ishii; Takayoshi Aoki; Koichi Tanaka; Shigeru Sadamatsu, all of Kanagawa, Japan

[73] Assignee: Fuji Xerox Co., Ltd., Tokyo, Japan

[21] Appl. No.: 275,629

[22] Filed: Nov. 16, 1988

Related U.S. Application Data

[63] Continuation of Ser. No. 6,350, Jan. 14, 1988, abandoned, which is a continuation of Ser. No. 708,901, Mar. 6, 1985, abandoned.

[30] Foreign Application Priority Data

Mar. 6, 1984 [JP] Japan ..... 59-41306

[51] Int. Cl.[5] ..... G03G 9/10

[52] U.S. Cl. ..... 430/110; 526/934; 525/934; 430/125; 430/111

[58] Field of Search ..... 430/110, 109, 111

[56] References Cited

U.S. PATENT DOCUMENTS

| | | | |
|---|---|---|---|
| 3,320,169 | 5/1967 | East et al. | 430/110 |
| 3,819,367 | 6/1974 | Chatterji et al. | 430/107 X |
| 3,895,125 | 7/1975 | Tsuchiya et al. | 430/111 X |
| 4,051,077 | 9/1977 | Fisher | 430/110 |
| 4,077,782 | 3/1978 | Drummond et al. | 55/139 |
| 4,254,203 | 3/1981 | Oka et al. | 430/903 |
| 4,301,228 | 11/1981 | Kori et al. | 430/110 X |

FOREIGN PATENT DOCUMENTS

| | | | |
|---|---|---|---|
| 134651 | 8/1983 | Japan | 430/110 |

*Primary Examiner*—David Welsh

*Attorney, Agent, or Firm*—Sughrue, Mion, Zinn, Macpeak & Seas

[57] ABSTRACT

A developer for an electrostatic latent image is disclosed, which comprises a carrier powder, a toner powder, and a fine powder that has a particle size smaller than that of the toner powder said fine powder being made of a polymer which is located closer to the carrier side of the triboelectric series than to the toner side. The developer does not cause insufficient cleaning or toner filming on a photoreceptor or electrostatic recording element.

4 Claims, No Drawings

DEVELOPER COMPOSITION FOR ELECTROPHOTOGRAPHY COMPRISING FINE PARTICLES

This is a continuation application of application Ser. No. 07/006,350, filed on 1-14-88, now abandoned which is a continuation of application Ser. No. 06/708,901 filed on Mar. 6, 1985, now abandoned.

BACKGROUND OF THE INVENTION

The present invention relates to a developer, and more particularly, to a developer designed to experience minimum deterioration in its characteristics.

The electrostatic latent image formed in electrophotography or electrostatic recording can be made visible, or developed, by a variety of techniques. In one method, a developer made of a mixture of toner and carrier is used and the toner particles that are charged by triboelectrification upon mixing with the carrier beads are attracted to oppositely charged sites on the photoreceptor or electrostatic recording element so as to produce a visible toner image. This toner image is transferred to a receiving sheet and fixed to reproduce a copy of the original. Because of incomplete transfer to the receiving paper, a toner image remains on the photoreceptor or electrostatic recording element, and therefore it must be cleaned before another copying cycle is started. This residual toner image is conventionally wiped off with a blade, brush or web. As the copying cycle is repeated several thousand to several tens of thousand times, a gradual buildup of the residual toner occurs on the surface of the photoreceptor or electrostatic recording element in spite of the cleaning step. In order to avoid this insufficient cleaning or 'toner filming', methods of mixing an additive with the developer composition have been proposed in British Patent No. 1,233,869, Japanese Patent Publication No. 1130/1976, Japanese Unexamined Published Patent Application Nos. 120631/1975 and 84741/1977. The additives proposed are organic polymers having low surface energy such as polytetrafluoroethylene and polyvinylidene fluoride (British Patent No. 1,233,869), non-clinging polymers whose static propensity is smaller than that of sulfur (Japanese Patent Publication No. 1130/1976), a mixture of such non-clinging polymer with an abrasive such as colloidal silica (Japanese Unexamined Published Patent Application No. 120631/1975), and polystyrene particles (Japanese Unexamined Published Patent Application No. 84741/1977). These materials either reduce the sticking of the toner to the photoreceptor or electrostatic recording element or polish away the residual toner particles and hence are effective to some extent in preventing insufficient cleaning or toner filming. However, the toner in the developer containing such additives is not as effectively charged by triboelectrification as in the developer containing no such additives. As the number of copying cycles exceeds 10,000~20,000, either a decreased image density or an increased fog occurs to such an extent that no further copying is possible. This phenomenon is particularly conspicuous in a hot and humid environment. Since the photoreceptor at this stage is free from the "toner filming", the decreased image density or increased fog is believed to have resulted from the decreased ability of the developer to charge the toner particles by triboelectrification.

SUMMARY OF THE INVENTION

An object of the present invention, therefore, is to provide a developer that does not cause insufficient cleaning or toner filming on the photoreceptor or electrostatic recording element, while preventing the occurrence of a decreased image density or increased fog.

As a result of various studies made to attain this object, the present inventors have found that very good results can be achieved by using a developer comprising a carrier powder, a toner powder, and a fine powder that has a particle size smaller than that of the toner powder and which is made of a polymer located closer to the carrier side of the triboelectric series than to the toner side. Equally good results are obtained by using a fine particulate polymer which is located on the side of the triboelectric series opposite the toner with respect to the carrier. The present invention has been accomplished on the basis of this finding.

The developer in accordance with the present invention can be completely cleaned off without causing damage to the latent image forming member. As a further advantage, the life of this developer is appreciably extended.

DETAILED DESCRIPTION OF THE INVENTION

The respective locations of the fine polymer powder and the toner powder in the triboelectric series may be determined by any conventional methods. A particularly preferred method is described below.

Provide carrier A having the propensity to be negatively charged, and carrier B having the propensity to be positively charged. The coordinate ($X_{toner}$ or $X_{fine\ powder}$) of powder to be determined (toner or fine powder) in the triboelectric series is defined as $a/|a-b|$ wherein a represents the amount of static charges ($\mu C/g$) on the powder with carrier A and b refers to the amount of static charges ($\mu C/g$) on the powder with carrier B. The coordinates of carriers A and B are supposed to be 0 and 1, respectively. Carriers A and B use the same core that is selected from among iron powder, ferrite powder and glass beads. The core of carrier A is covered with a solid (pinhole-free) coat of a known strong negatively chargeable resin such as polytetrafluoroethylene, polyvinylidene fluoride, vinylidene chloride, vinylidene chloride-acrylonitrile copolymer, vinylidene chloride-acrylonitrile-acrylic acid copolymer, vinyl chloride polymer, vinyl chloride-trifluoromonochloroethylene copolymer, vinyl chloride-vinyl acetate copolymer, monochlorotrifluoroethylene-vinylidene chloride copolymer or nitrocellulose resin. The core of carrier B is covered with a solid (pinhole-free) coat of a known strong positively chargeable resin such as methyl methacrylate polymer, methyl methacrylate-styrene copolymer, ethyl cellulose or polyvinylpyridine.

In accordance with the method shown above, the expression that "a fine powder located closer to the carrier side of the triboelectric series than to the toner side" is defined mathematically by:

$$|X_{toner}-1| > |X_{fine\ powder}-1| \quad (1a),$$

or $$|X_{toner}| > |X_{fine\ powder}| \quad (1b)$$

wherein (1a) presupposes a positively charged carrier and (1b) a negative charged carrier. The expression that "a fine powder located on the side of the triboelectric series opposite the toner with respect to the carrier" is defined by:

$$X_{fine\ powder} > 1 \text{ and } X_{toner} < 1 \quad (2a),$$

or $$X_{fine\ powder} < 0 \text{ and } X_{toner} > 0 \quad (2b)$$

wherein (2a) presupposes a positively charged carrier and (2b) a negatively charged carrier.

The fine particles in accordance with the present invention may be made of any of the known materials described in the already cited prior art references so long as they sastisfy either one of the above criterion formulas. However, better results are obtained by the fine particles of at least one organic polymer that is selected from an acrylic polymer, an acryl/styrene copolymer, a homopolymer or copolymer of a nitrogen-containing addition-polymerizable monomer, a homopolymer or copolymer of a polymerizable unsaturated carboxylic acid, and a homopolymer or copolymer of an addition-polymerizable vinyl compound, and which satisfies either one of the above formulas.

Illustrative monomers that make up such polymer powders are esters of acrylic acid or methacrylic acid with alcohols such as alkyl alcohols, halogenated alkyl alcohols, alkoxyalkyl alcohols, aralkyl alcohols and alkenyl alcohols. Exemplary alcohols are listed below:

Alkyl alcohols such as methyl alcohol, ethyl alcohol, propyl alcohol, butyl alcohol, amyl alcohol, hexyl alcohol, heptyl alcohol, octyl alcohol, nonyl alcohol, dodecyl alcohol, tetradecyl alcohol and hexadecyl alcohol; halogenated alkyl alcohols wherein part of such alkyl alcohols is halogenated; alkoxyalkyl alcohols such as methoxyethyl alcohol, ethoxyethyl alcohol, ethoxyethoxyethyl alcohol, methoxypropyl alcohol and ethoxypropyl alcohol; aralkyl alcohols such as benzyl alcohol, phenylethyl alcohol, and phenylpropyl alcohol; and alkenyl alcohols such as ally alcohol and crotonyl alcohol.

These acrylic monomers may be homopolymerized or copolymerized with other monomers. Examples of the copolymerizable monomers that may be used with the acrylic monomers are listed below:

Styrene; alkylstyrenes such as methystyrene, dimethylstyrene, trimethylstyrene, ethylstyrene, diethylstyrene, triethylstyrene, propylstyrene, butylstyrene, hexylstyrene, heptylstyrene and octylstyrene; halogenated styrenes such as fluorostyrene, chlorostyrene, bromostyrene, dibromostylene and iodostyrene; as well as nitrostyrene; acetylstyrene and methoxystyrene.

Polymerizable unsaturated carboxylic acids may also be used, and they include addition-polymerizable unsaturated aliphatic monocarboxylic acids such as α-ethylacrylic acid, crotonic acid, α-methylcrotonic acid, α-ethylcrotonic acid, isocrotonic acid, tiglic acid, and ungulinic acid; as well as addition-polymerizable unsaturated aliphatic dicarboxylic acids such as maleic acid, fumaric acid, itaconic acid, citraconic acid, mesaconic acid, glutaconic acid and dihydromuconic acid. These cargoxylic acids may be used in the form of metal salts. The formation of such metal salts may be effected after the completion of polymerization.

The addition-polymerizable unsaturated carboxylic acids may also be esterified with alcohols such as alkyl alcohols, halogenated alkyl alcohols, alkoxyalkyl alcohols, aralkyl alcohols and alkenyl alcohols, as described above. Other usable monomers include amides and nitriles derived from such addition-polymerizable unsaturated carboxylic acids; aliphatic monoolefins such as ethylene, propylene, butene and isobutylene; and conjugated diene type aliphatic diolefins such as 1,3-butadiene, 1,3-pentadiene, 2-methyl-1,3-butadiene, 2,3-dimethyl-1,3-butadiene, 2,4-hexadiene and 3-methyl-2,4-hexadiene.

Other suitable monomers include vinyl acetates and vinyl ethers; nitrogen-containing vinyl compounds such as 2-vinylpyridine, 4-vinylpyridine, 2-vinyl-6-methylpyridine, 2-vinyl-5-methylpyridine, 4-butenylpyridine, 4-pentylpyridine, N-vinylpiperidine, 4-vinylpiperidine, N-vinyldihydropyridine, N-vinylpyrrole, 2-vinylpyrrole, N-vinylpyrroline, N-vinylpyrrolidine, 2-vinylpyrrolidine, N-vinyl-2-pyrrolidone, N-vinyl-2-piperidone and N-vinylcarbazole; and vinyl silane compounds such as vinyl trimethoxysilane and vinyl triethoxysilane.

Halogen-containing addition-polymerizable monomers may also be used, and they include halogenated olefins such as monofluoroethylene, difluoroethylene, trifluoroethylene, tetrafluoroethylene, monochloroethylene, dichloroethylene, trichloroethylene, tetrachloroethylene, difluorodichloroethylene, trifluoromonochloroethylene and hexafluoropropylene.

The fine powder in accordance with the present invention is made of either homopolymers or copolymers of the monomers listed above and should satisfy the requirement set forth by the above formula. Most importantly, the chemical structure of a carrier, especially the polymer coat on the carrier core, should be considered. When a methyl methacrylate coated carrier is used, the fine powder of a polymer made of a monomer such as vinylpyridine which has such a chemical structure that it has a greater tendency to be positively charged should be selected in order to satisfy either one of the above formulas.

The fine polymer particles used in the present invention that have an average size smaller than that of the toner particles may be prepared by a variety of techniques. For example, they may be directly obtained by emulsion polymerization, soap-free emulsion polymerization or suspension polymerization. Alternatively, a polymer obtained by one of these methods or by suspension polymerization or bulk polymerization may be dissolved in a solvent and subsequently reduced into particles by spray-drying or mechanical grinding techniques.

The fine particles of a polymer in accordance with the present invention may be used in combination with those of another polymer. If desired, other additives may also be used in combination with the fine particles of the present invention.

The fine particles according to the present invention must have an average size smaller than that of the toner particles. Particularly good results are obtained by particles whose size ranges from 0.05 to 5 μm, preferably 0.1–2 μm.

The fine particles according to the present invention may be used in an amount of 0.01–10 wt % of the toner. Better results are obtained by using the particles in an amount of 0.05–2.0 wt % of the toner.

The developer of the present invention is prepared by blending the fine polymer particles shown above with known toners. The binder resin used in the toner is selected from homopolymers and copolymers of the following illustrative monomers: styrenes such as styrene, chlorostyrene and vinyl-styrene; monoolefins such as ethylene, propylene, butylene and isobutylene; vinyl esters such as vinyl acetate, vinyl propionate, vinyl benzoate and vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl ketone, vinyl hexyl ketone and vinyl isopropenyl ketone. Typical binder resins include polystyrene, styrene-alkyl acrylate copolymers, styrene-alkyl methacrylate copolymers, styrene-acrylonitrile copolymer, styrene-butadiene copolymer, styrene-maleic anhydride copolymer, polyethylene and polypropylene. Other materials suitable for use as the binder resin include polyesters polyurethanes epoxy resins, silicone resins, polyamides, modified rosin, paraffin and waxes.

The toner also contains a colorant, and typical examples of the colorant include carbon black, Nigrosine dyes, Aliline Blue, Alcohoil Blue, Chrome Yellow, Ultramarine Blue, DuPont Oil Red, Quinoline Yellow, Methylene Blue chloride, Phthalocyanine Blue, Malachite Green oxalate, Lamp Black and Rose Bengal.

Needless to say, the binder resin and colorant that can be incorporated in the toner in accordance with the present invention are not limited to the particular examples shown above.

Magnetic toners encapsulating magnetic materials may also be used.

The toner particles in accordance with the present invention generally have an average size smaller than about 30 μm, preferably between 3 and 20 μm.

In the present invention, any conventional type carrier may be used. For example, an iron powder, a ferrite powder or glass beads may be used either uncoated or coated with one of the resins listed above.

The developer of the present invention may be employed to develop an electrostatic latent image that has been formed on a photoreceptor or an electrostatic recording element. The electrostatic latent image is formed electrophotographically on a photoreceptor made of an inorganic photoconductive material such as selenium, zinc oxide, cadmium sulfide or amorphous silicon, or an organic photoconductive material such as a phthalocyanine dye or bisazo dye. Alternatively, the latent image may be formed by, for example, needle electrodes on an electrostatic recording element having a dielectric such as polyethylene terephthalate. The latent image is subjected to the magnetic brush development, cascade development or touchdown development so as to produce a toner image by the developer of the present invention which is attracted to selected sites on the photoreceptor or electrostatic recording element. The toner image is then transferred to a receiving sheet, usually paper, and is fixed to provide a reproduced copy. The residual toner particles are wiped off the surface of the photoreceptor or electrostatic recording element by a suitable cleaning method using a blade, brush, web or roll.

The developer of the present invention provides the following advantages.

1. Insufficient cleaning can be prevented.

The residual toner particles sticking to the surface of a photoreceptor or electrostatic recording element can be completely cleaned even after as many as fifty thousand copies have been reproduced. A developer using known additives ensures satisfactory cleaning of the residual toner if the number of copies reproduced is small. However, the removability of toner particles is gradually decreased and after more than 20,000–30,000 copies have been reproduced, an excessive buildup of the residual toner cause overlapping images or black stripes in the copy reproduced in the subsequent cycle.

2. The developer has a prolonged life.

The performance of the developers, particularly their ability to be charged by triboelectrification, is inevitably decreased as the number of copies reproduced is increased. This tendency is especially great in a developer using prior art additives. However, the developer of the present invention is less likely to suffer the decrease in its developing capability, and at least fifty thousand copies of an original having an image density of 0.7 which has the greatest possibility of density drop can be reproduced with satisfactory results, and the decrease in density of the copied image is substantially zero. This advantage is not lost even under hot and humid conditions.

3. The developer is the least likely to cause damage to the photoreceptor or electrostatic recording element, and is substantially free from the chance of toner filming.

The advantages of the present invention will be apparent from the following Examples and Comparative Examples. In the Examples and Comparative Examples, all parts are by weight.

The coordinates in the triboelectric series of the fine powders used in Examples 1 and 2, as well as in Comparative Example 1 were determined by measuring the blow-off static amount of a mixture of the fine powder (3 parts), and carriers B and A (100 parts) that had been prepared by stirring the respective components for 1 hour in a jar mill. The results are shown in Table 1.

Carriers A and B were prepared by coating poly(methyl methacrylate) and poly (4-fluoroethylene), respectively, on spherical iron oxide particles having an average size of 100 μm in a fluidized bed in an amount of 0.6 wt % based on the weight of the iron oxide particles.

TABLE 1

| | Sample No. | Composition | Particle size μm | Coordinate in triboelectric series |
|---|---|---|---|---|
| Sample of the present invention | 1 | methyl methacrylate/4-vinylpyridine (70/30) copolymer as prepared by soap-free emulsion polymerization | 0.3 | 1.5 |
| | 2 | methyl methacrylate/4-vinylpyridine (50/50) copolymer as prepared by soap-free emulsion polymerization | 0.5 | 2.0 |
| Conventional sample | 3 | teraphthalic acid | 0.5 | −3.2 |

EXAMPLE 1

Ninety parts of a styrene-butyl-methacrylate copolymer (SMB 730, product of Sanyo Chemical Industries, Ltd.) was blended in a Banbury mixer with 10 parts of carbon black. The mixture was ground into particles which was classified to have a predetermined size distribution (average particle size: about 12 μm). A hundred parts of the resulting toner particles was blended in a Henschel mixer with 0.5 part of the fine particles of a methyl methacrylate/4-vinylpyridine (70/30) copolymer (Sample No. 1) to prepare a toner composition.

Three parts of carrier B was mixed with 100 parts of the toner composition so as to provide a developer in accordance with the present invention.

EXAMPLE 2

A developer in accordance with the present invention was prepared as in Example 1 except that the fine powder of a methyl methacrylate/4-vinylpyridine (50/50) copolymer (Sample No. 2) was used.

COMPARATIVE EXAMPLE 1

A control developer was prepared as in Example 1 except that the fine powder of terephthalic acid (Sample No. 3) was used as the toner additive.

COMPARATIVE EXAMPLE 2

Another control developer was prepared as in Example 1 except that no fine powder was incorporated in the toner.

EXPERIMENT

The developer samples prepared in Examples 1 and 2, as well as in Comparative Examples 1 and 2 were subjected to a copying test for reproducing one hundred thousand copies with a photocopier Model 4370 of Fuji Xerox Co., Ltd. The test results are summarized in Table 2, from which one can clearly see the superior properties of the developers prepared in accordance with the present invention.

TABLE 2

| | Factors | | | | | |
|---|---|---|---|---|---|---|
| | | | | Static amount μC/g | | |
| Developer sample | Poor cleaning | Flows on photo-receptor | Toner filming | Initial | after reproduction of $10^5$ copies | Developer life* |
| Example 1 | none before $10^5$ copies were reproduced | none | none | 15 | 18 | $>10^5$ |
| Example 2 | none before $10^5$ copies were reproduced | " | " | 16 | 19 | " |
| Comparative Example 1 | none before $10^5$ copies were reproduced | " | " | 17 | 10 | $5 \times 10^4$ |
| Comparative Example 2 | more than 100 copies during the reproduction of $10^5$ copies | extensive (photo-receptor replace ments were necessary) | Extensive | 15 | 10 | $5 \times 10^4$ |

*The life of the developer is indicated in terms of the number of copies of an original with an image density of 0.7 that could be reproduced at a density of at least 0.7 and a fog density of not higher than 0.02.

While the invention has been described in detail and with reference to specific embodiments thereof, it will be apparent to one skilled in the art that various changes and modifications can be made therein without departing from the spirit and scope thereof.

What is claimed is:

1. A developer comprising:

(a) a carrier powder containing a polymer of methyl methacrylate, a copolymer of methyl methacrylate and styrene, an ethylene cellulose, or polyvinylpyridine, (b) a toner powder having a colorant dispersed in a binder resin and having an average particle size of from 3 to 20 μm, and (c) a fine powder composed of an acrylic polymer, having an average particle size of from 0.1 to 2 μm, contained in the developer in an amount of from 0.01 to 10% by weight based on the weight of the toner powder, and being positively chargeable by triboelectrification with the carrier powder.

2. A developer as claimed in claim 1, wherein the fine powder is contained in an amount of from 0.05 to 2% by weight based on the weight of the toner powder.

3. A developer as claimed in claim 1, wherein the binder resin of the toner powder is a styrene polymer or a copolymer of styrene and an acrylic acid ester.

4. A developer as claimed in claim 1, wherein the acrylic polymer is a homopolymer or a copolymer containing a monomer component selected from esters of acrylic acid or methacrylic acid with alcohols selected from the group consisting of alkyl alcohols, halogenated alcohols, alkoxyalkyl alcohols, aralkyl alcohols, and alkenyl alcohols.

* * * * *